US008188918B2

(12) United States Patent
Surittikul et al.

(10) Patent No.: US 8,188,918 B2
(45) Date of Patent: May 29, 2012

(54) ANTENNA SYSTEM HAVING A STEERABLE RADIATION PATTERN BASED ON GEOGRAPHIC LOCATION

(75) Inventors: Nuttawit Surittikul, Bangkok (TH); Wladimiro Villarroel, Ypsilanti, MI (US); Kwan-ho Lee, Ann Arbor, MI (US)

(73) Assignee: AGC Automotive Americas R&D, Inc., Ypsilanti, MI (US)

( * ) Notice: Subject to any disclaimer, the term of this patent is extended or adjusted under 35 U.S.C. 154(b) by 224 days.

(21) Appl. No.: 12/513,064

(22) PCT Filed: Nov. 1, 2007

(86) PCT No.: PCT/US2007/023052

§ 371 (c)(1),
(2), (4) Date: Feb. 3, 2010

(87) PCT Pub. No.: WO2008/054803

PCT Pub. Date: May 8, 2008

(65) Prior Publication Data

US 2010/0141517 A1 Jun. 10, 2010

Related U.S. Application Data

(60) Provisional application No. 60/864,082, filed on Nov. 2, 2006.

(51) Int. Cl.
*H01Q 3/02* (2006.01)

(52) U.S. Cl. ..... 342/374

(58) Field of Classification Search ..... 342/374
See application file for complete search history.

(56) References Cited

U.S. PATENT DOCUMENTS

| | | | |
|---|---|---|---|
| 3,537,011 | A | 10/1970 | Escoula |
| 3,670,275 | A | 6/1972 | Kalliomaki et al. |
| 4,626,858 | A | 12/1986 | Copeland |
| 5,293,172 | A | 3/1994 | Lamberty et al. |
| 5,294,939 | A | 3/1994 | Sanford et al. |
| 5,347,286 | A | 9/1994 | Babitch |
| 5,349,360 | A | 9/1994 | Matsui |
| 5,734,349 | A | 3/1998 | Lenormand et al. |

(Continued)

FOREIGN PATENT DOCUMENTS

| | | | |
|---|---|---|---|
| EP | 1662676 | A1 | 5/2006 |

(Continued)

OTHER PUBLICATIONS

English language translation and abstract for JP2006115451 extracted from PAJ database dated Aug. 4, 2009, 176 pages.

(Continued)

*Primary Examiner* — Harry Liu
(74) *Attorney, Agent, or Firm* — Howard & Howard Attorneys PLLC

(57) ABSTRACT

An antenna system (10) for receiving satellite signals in a vehicle exhibits a radiation pattern (11). The antenna system (10) includes a plurality of parasitic elements (18) which are electrically connectable together using linking switches (20). The geometry of the radiation pattern (11) changes as the linking switches (20) are activated and deactivated. Control of the linking switches (20), and thus the geometry of the radiation pattern (11), is based on the geographic location of the antenna system (10). Thus, the radiation pattern (10) can be steered based on geographic location to enhance signal reception. The geographic location may be obtained automatically via a GPS receiver (30) or manually via a user.

28 Claims, 4 Drawing Sheets

U.S. PATENT DOCUMENTS

| | | | | |
|---|---|---|---|---|
| 5,760,744 | A | 6/1998 | Sauer | |
| 6,249,255 | B1 | 6/2001 | Eggleston | |
| 6,317,100 | B1 | 11/2001 | Elson et al. | |
| 6,633,258 | B2 | 10/2003 | Lindenmeier et al. | |
| 6,640,085 | B1 | 10/2003 | Chatzipetros et al. | |
| 6,697,019 | B1 | 2/2004 | Hyuk-Joon et al. | |
| 6,768,457 | B2 | 7/2004 | Lindenmeier | |
| 6,828,938 | B2 | 12/2004 | Tran | |
| 6,876,337 | B2 | 4/2005 | Larry | |
| 6,882,312 | B1 | 4/2005 | Vorobiev et al. | |
| 2006/0012521 | A1 * | 1/2006 | Small | 342/386 |
| 2006/0046639 | A1 | 3/2006 | Walker et al. | |

FOREIGN PATENT DOCUMENTS

| | | | |
|---|---|---|---|
| GB | 2265495 | A | 9/1993 |
| JP | 2006115451 | A | 4/2006 |

OTHER PUBLICATIONS

PCT International Search Report for PCT/US2007/023052, dated Jul. 2, 2008, 4 pages.

Article: Surittikul et al., "Analysis of Reconfigurable Printed Antenna using Characteristic Modes", IEEE Antennas and Propagation Society Symposium, vol. 2, No. 20, 2004, pp. 1808-1811.

Article: Zhang et al., "A Pattern Reconfigurable Micorstrip Parasitic Array", IEEE Transactions on Antennas and Propagation, vol. 52, No. 10, 2004, pp. 2773-2776.

* cited by examiner

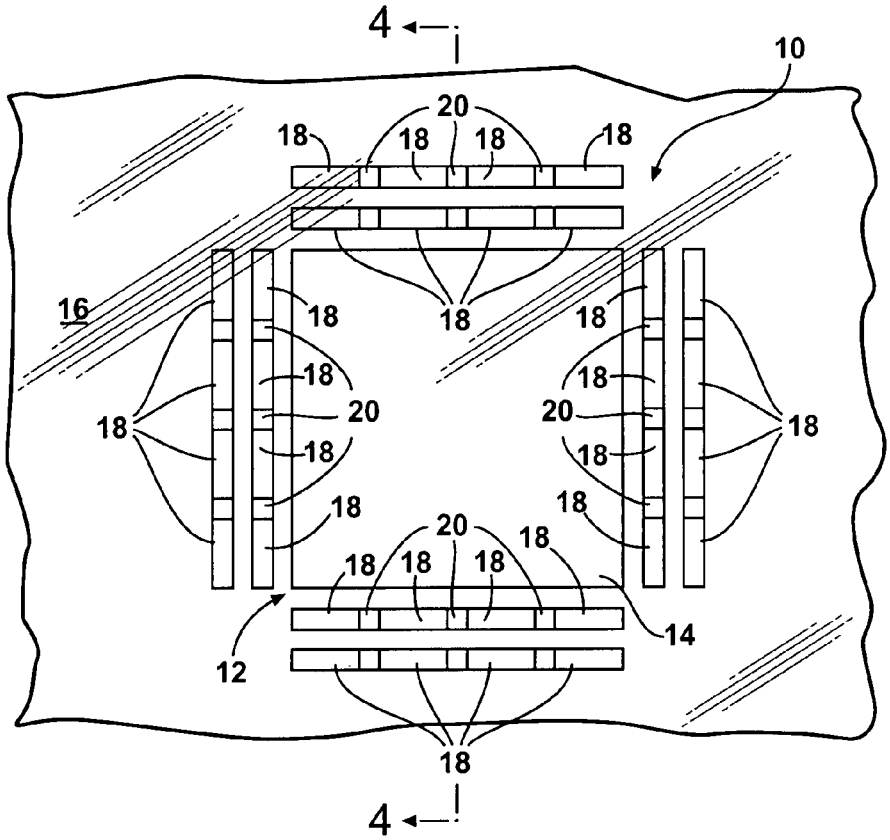
FIG - 3
FIG - 4
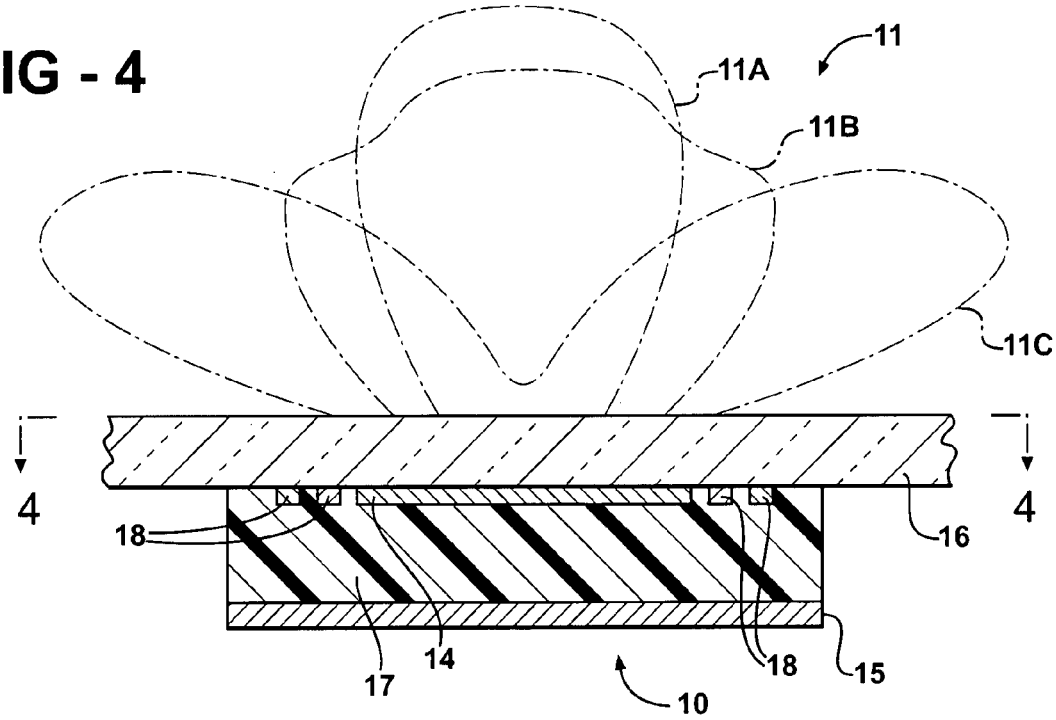

ANTENNA SYSTEM HAVING A STEERABLE RADIATION PATTERN BASED ON GEOGRAPHIC LOCATION

RELATED APPLICATIONS

This application claims priority to and all the advantages of International Patent Application No. PCT/US2007/023052, filed on Nov. 1, 2007, which claims priority to U.S. Provisional Patent Application No. 60/864,082, filed on Nov. 2, 2006.

BACKGROUND OF THE INVENTION

1. Field of the Invention

The subject invention relates generally to an antenna system having a radiation pattern that is steerable. Specifically, the radiation pattern is steerable based on geographic location to receive a signal from a satellite, such as a digital radio satellite.

2. Description of the Related Art

Antenna systems for receiving signals from a satellite, such as Satellite Digital Audio Radio Service (SDARS) signals, are well known in the art. Typically, these antenna systems provide a radiation pattern with an unchanging geometry to receive the SDARS signals. This can lead to poor performance of the antenna system in some geographic locations where the geometry of the radiation pattern and an angle between the satellite and the antenna system are less than optimal.

Antenna systems for receiving SDARS signals are routinely carried on vehicles for use with the vehicle's radio receiver. Typically, these antenna systems are roof-mounted and have a bulky appearance which is not aesthetically pleasing. However, vehicle manufacturers have been cautious in integrating SDARS antenna systems with windows of the vehicle, due to the potential obstruction of view caused by the antenna to the driver. Therefore, it is typically a requirement that the antenna occupy less than a certain surface area, or "footprint", when integrated with the window.

Some prior art antenna systems utilize multiple radiating elements, i.e., an antenna array, where each radiating element produces a different radiation pattern. These systems involve complex switching and/or signal processing techniques to select the radiating element with the most favorable radiation pattern. Unfortunately, these systems can be expensive due to the number of radiating elements and the complex circuitry utilized. Moreover, it is difficult to dispose multiple radiating elements on a window of a vehicle, due to the obstruction of view they cause.

Therefore, there remains an opportunity for a cost efficient and non-obstructive antenna system with a radiation pattern that is steerable based on geographic location.

SUMMARY OF THE INVENTION AND ADVANTAGES

The subject invention is an antenna system exhibiting a radiation pattern that is steerable based upon geographic location. The antenna system includes a radiating element for exciting the radiation pattern. A plurality of parasitic elements is disposed in proximity of the radiating element such that the parasitic elements affect a geometry of the radiation pattern. At least one linking switch is electrically connected to at least two of the parasitic elements. The at least one linking switch is activatable to electrically connect the at least two parasitic elements based on the geographic location of the antenna to steer the radiation pattern.

The subject invention also provides a method of steering the radiation pattern of the antenna system based upon geographic location. The method includes the steps of exciting the radiation pattern with the radiation element and electrically connecting at least two of the parasitic elements together with the linking switch based on the geographic location to steer the radiation pattern.

The subject invention provides an antenna system and method that enhances reception of satellite radio signals by steering its radiation pattern based on its geographical location by electrically connecting the parasitic elements with the linking switches. Furthermore, the antenna system requires only a single radiating element. Therefore, the antenna system can be implemented at a lower cost when compared to multiple radiating element array antennas. Also, when placed on a window of a vehicle, the single radiating element does not obstruct the view of a driver as would multiple radiating element antennas.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 3 is a top view of a third embodiment of the antenna system showing eight lines of parasitic elements and linking switches with a pair of lines disposed along each side of the conductive patch;

FIG. 4 is a cross-sectional view of the third embodiment of the antenna system taken along line 4-4 in FIG. 3 and showing a plurality of potential radiation patterns;

DETAILED DESCRIPTION OF THE INVENTION

Figure 1:
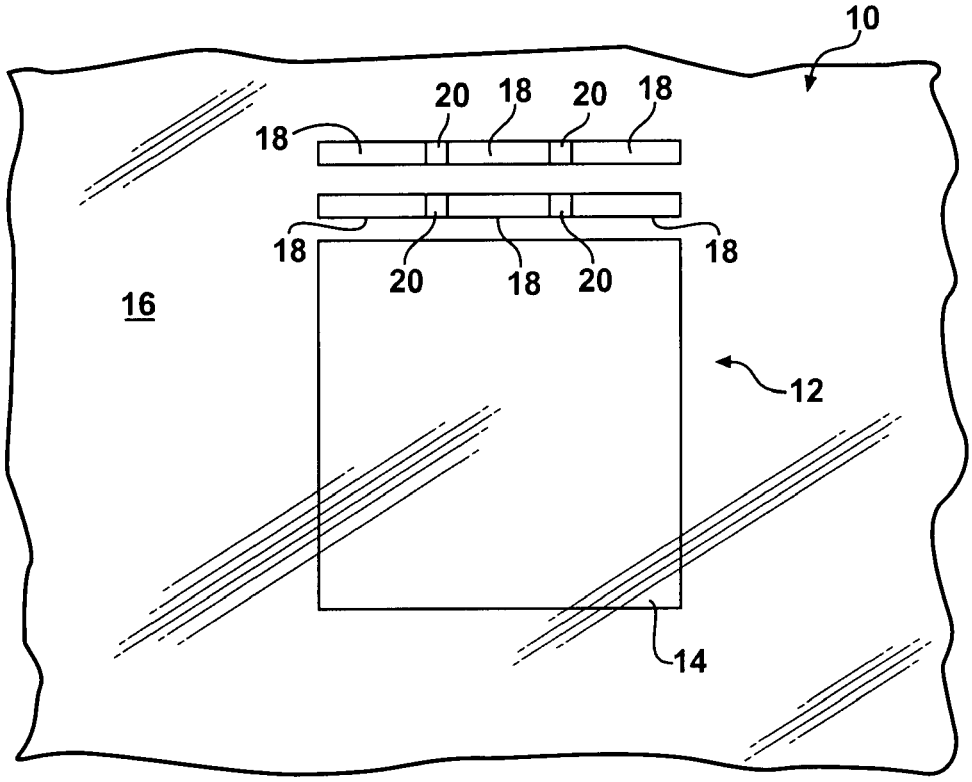
FIG. 1 is a top view of a first embodiment of an antenna system showing two lines of parasitic elements and linking switches disposed along one side of a conductive patch.

Referring to the Figures, wherein like numerals indicate corresponding parts throughout the several views, an antenna system is generally shown at 10. The antenna system 10 exhibits a radiation pattern 11 that is steerable based upon its geographic location, i.e., its position on or above the Earth. Furthermore, the subject invention discloses a method as described below.

The antenna system 10 of the illustrated embodiments is utilized to receive a circularly polarized radio frequency (RF) signal from a satellite such as the left-hand circularly polarized (LHCP) RF signals produced by a Satellite Digital Audio Radio Service (SDARS) provider, such as XM® Satellite Radio or SIRIUS® Satellite Radio. However, it is to be understood that the antenna system 10 may also receive a righthand circularly polarized (RHCP) RF signal. Also, the antenna system 10 may also be configured to receive linearly polarized RF signals that are either vertically or horizontally orientated. Furthermore, those skilled in the art realize that the antenna system 10 may also be used to transmit the circularly and linearly polarized RF signals.

Referring to FIGS. 1-4, the antenna system 10 includes a radiating element 12 for exciting the radiation pattern 11. The radiating element 12 is formed of an electrically conductive material. In the illustrated embodiments, the radiating element 12 is a conductive patch 14. Other implementations of the radiating element 12 are possible as is known by those skilled in the art. However, for convenience purposes only, the conductive patch 14 is substituted herein for the radiating element 12, but this substitution should not be read in any way as limiting.

The conductive patch 14 is a substantially flat area of conductive material. Moreover, the conductive patch 14 is preferably rectangularly shaped and more preferably square shaped. Due to its preferred shape, the conductive patch 14 has at least four sides (not numbered). Each side of the conductive patch 14 is typically one-half wavelength of the desired frequency (or center of the desired frequency band) for the antenna system 10. However, other shapes and dimensions for the conductive patch 14 are also possible as is realized by those skilled in the art. The size of the conductive patch 14 is determined primarily by the frequencies in which the antenna system 10 is designed to operate, as is also well known to those skilled in the art.

In the illustrated embodiments, the conductive patch 14 is disposed on a non-conductive pane 16. The non-conductive pane 16 is preferably a window (not shown) of a vehicle (not shown). Specifically, the non-conductive pane 16 is formed of glass. The glass is preferably automotive glass and more preferably soda-lime-silica glass. Those skilled in the art, however, realize that the nonconductive pane 16 may be formed from plastic, fiberglass, or other suitable nonconductive materials. The non-conductive pane 16 formed of glass defines a thickness between 1.5 and 5.0 mm, preferably 3.1 mm. The non-conductive pane 16 formed of glass also has a relative permittivity between 5 and 9, preferably 7. The non-conductive pane 16 further functions as a radome to the antenna system 10. That is, the non-conductive pane 16 protects the other components of the antenna system 10, as described in detail below, from moisture, wind, dust, etc. that are present outside the vehicle.

In operation, the radiating element 12 is in communication with a radio receiver (not shown) via a transmission line (not shown). Specifically, the transmission line is electrically connected to the radiating element 12 either directly or with an electromagnetic coupling. Alternatively, when used for transmitting, the transmission line is connected to a transceiver (not shown) or transmitter (not shown) instead of the receiver.

Referring specifically to FIG. 4, the antenna system 10 of the illustrated embodiments may also include a ground plane 15 formed of a conductive material. The ground plane 15 is disposed apart from the conductive patch 14. The ground plane 15 is preferably separated by a dielectric 17 formed of non-conductive material.

Figure 2:
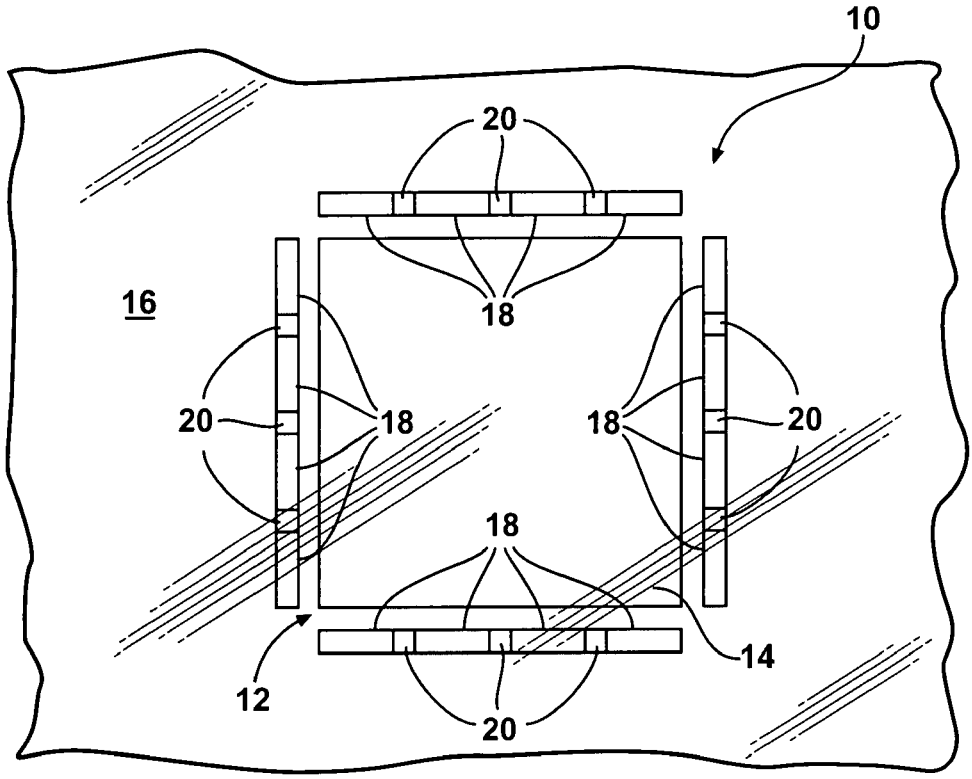
FIG. 2 is a top view of a second embodiment of the antenna system showing four lines of parasitic elements and linking switches with each line disposed along each side of the conductive patch.

Referring now to FIGS. 1-3, the antenna system 10 includes a plurality of parasitic elements 18 disposed in proximity of the radiating element 12, i.e., the conductive patch 14 of the illustrated embodiment. The parasitic elements 18 are formed of an electrically conductive material. Due to their proximity with the radiating element 12, the parasitic elements 18 affect a geometry of the radiation pattern 11. Close proximity of the parasitic elements 18 and the radiating element 12 is necessary to achieve a strong coupling between these elements 12, 18. Preferably, the distance between the elements 12, 18 is between 0.01 and 0.1 wavelengths of the desired frequency (or center frequency) of the antenna system 10.

In the illustrated embodiments, the parasitic elements 18 are also disposed on the non-conductive pane 16. Thus, the conductive patch 14 and the parasitic elements 18 are generally co-planar with one another. Furthermore, in the illustrated embodiments, the conductive patch 14 and the parasitic elements 18 are formed of a silver paste as the electrically conductive material that is disposed directly on the non-conductive pane 16 and hardened by a firing technique known to those skilled in the art. Other techniques for forming the conductive patch 14 and the parasitic elements 18 are well known to those skilled in the art.

In the illustrated embodiments, the parasitic elements 18 are arranged linearly as lines (not numbered) of parasitic elements 18. In a first embodiment, as shown in FIG. 1, the parasitic elements 18 are arranged as a pair of lines. Each line of parasitic elements 18 is disposed apart from the other lines and apart from the conductive patch 14. Furthermore, in the first embodiment, the lines of parasitic elements 18 are generally parallel to one another and to one of the sides of the conductive patch 14. In a second embodiment, as shown in FIG. 2, the parasitic elements 18 are arranged as four lines. Each line is disposed parallel to and apart from one of the sides of the conductive patch 14. In a third embodiment, as shown in FIGS. 3 and 4, the parasitic elements 18 are arranged as eight lines. A pair of lines are disposed adjacent to and parallel with each side of the conductive patch 14. As with the first and second embodiments, the lines of parasitic elements 18 are disposed apart from one another and apart from the conductive patch 14. Of course, other techniques for arranging the parasitic elements 18 other than linearly are evident to those skilled in the art.

The antenna system 10 also includes at least one linking switch 20. The linking switch 20 is electrically connected to at least two of the parasitic elements 18. When activated, each linking switch 20 electrically connects the at least two parasitic elements 18 together. When electrically connected together, the parasitic elements 18 steer the radiation pattern 11. Said another way, when connected together, the parasitic elements 18 change the radiation pattern 11 such that it is different from the radiation pattern produced when the parasitic elements 18 are not electrically connected to one another.

In the illustrated embodiments, the at least one linking switch 20 is implemented as a plurality of linking switches 20. Furthermore, in the illustrated embodiments, each linking switch 20 is electrically connected to two of the parasitic elements 18. However, one linking switch 20 could connect more than two parasitic elements 18 and a single linking switch 20 could be utilized to connect all of the parasitic elements 18 together.

Figure 5:
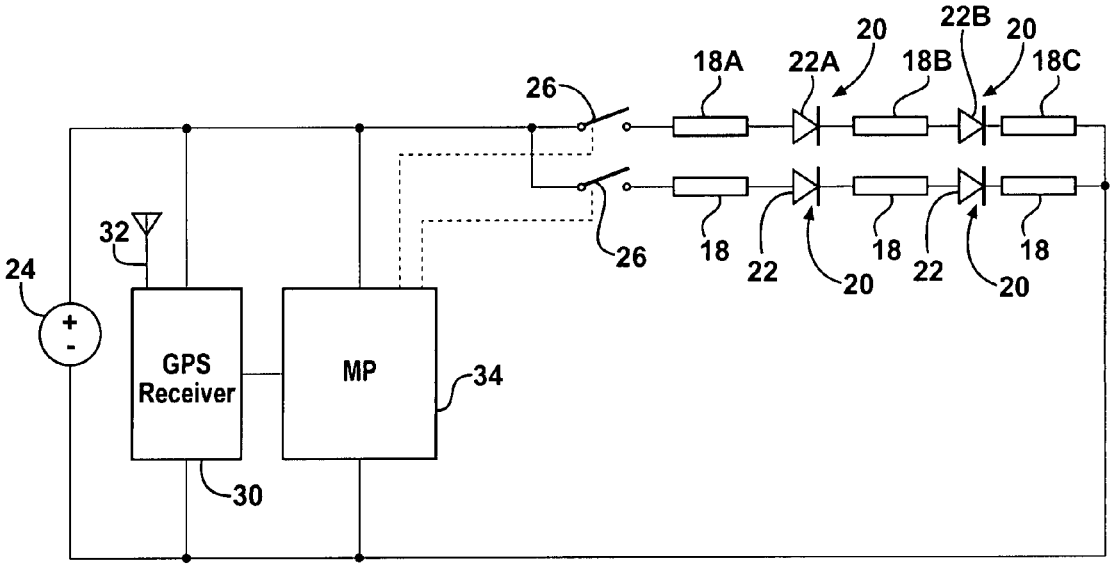
FIG. 5 is a schematic diagram of a circuit showing diodes implemented as the linking switches and activated automatically based on a geographic location from a GPS receiver.

In a first configuration, as shown in FIG. 5, each linking switch 20 is implemented as a diode 22. In the illustrated embodiments, the arrangement and connection of the diodes 22 is such that current can flow in one direction along an entire length of each line of parasitic elements 18. For instance, three parasitic elements 18 may be referred to as a first parasitic element 18A, a second parasitic element 18B, and a third parasitic element 18C. The diodes 22 may be referred to as a first diode 22A and a second diode 22B. An anode of the first diode 22A is electrically connected to the first parasitic element 18A and a cathode of the first diode 22A is electrically connected to the second parasitic element 18B. An anode of the second diode 22B is electrically connected to the second parasitic element 22B and a cathode of the second diode 22B is electrically connected to the third parasitic element 18C. The same general configuration may also apply to the other parasitic elements 18 and diodes 22, as is recognized by those skilled in the art.

In the first configuration of the linking switches 20, the antenna system 10 also includes a voltage source 24. The voltage source 24 is electrically connectable to the first parasitic element 18A and the third (and last) parasitic element 18C and has a voltage sufficient to allow current flow through the diode 22A, 22B. Thus, when the voltage source 24 is applied to the first and third parasitic elements 18A, 18C the parasitic elements 18A, 18B, 18C are electrically connected together.

Also in the first configuration, the antenna system 10 further includes an activation switch 26 electrically connected between the voltage source 24 and the first parasitic element 18A. The activation switch 26 selectively connects the voltage source 24 to the first parasitic element 18A. Thus electrical conductivity of the first, second, and third parasitic elements 18A, 18B, 18C may be controlled by the activation and deactivation of the activation switch 26. The activation switch 26 may be implemented as either a mechanical-type switch or a semiconductor-based switch. The mechanical-type switch may be a microelectromechanical systems (MEMS) switch. Other suitable devices to implement the activation switch 26 are known to those skilled in the art.

As the antenna system 10 of the illustrated embodiments include multiple lines of parasitic elements 18, the antenna system 10 may also include multiple activation switches 26. Activation and deactivation of the activation switches 26 is based on a geographic location of the antenna system 10. By selectively activating and deactivating the activation switches 26, the electrical connections between the various parasitic elements 18 are altered. This, in turn, alters the radiation pattern 11 of the antenna system 10. As can be seen in FIG. 4, the antenna system 10 may present multiple radiation patterns 11A, 11B, 11C based on which activation switches 26 are activated and deactivated. Thus, the antenna system 10 may present the radiation pattern 11A, 11B, 11C that is best suited to receive the signal from the satellite, based on the geographic location of the antenna system 10. Other implementations in which the activation switches 26 and/or linking switches 20 are individually and independently activated and deactivated are possible as is contemplated by one skilled in the art.

Figure 6:
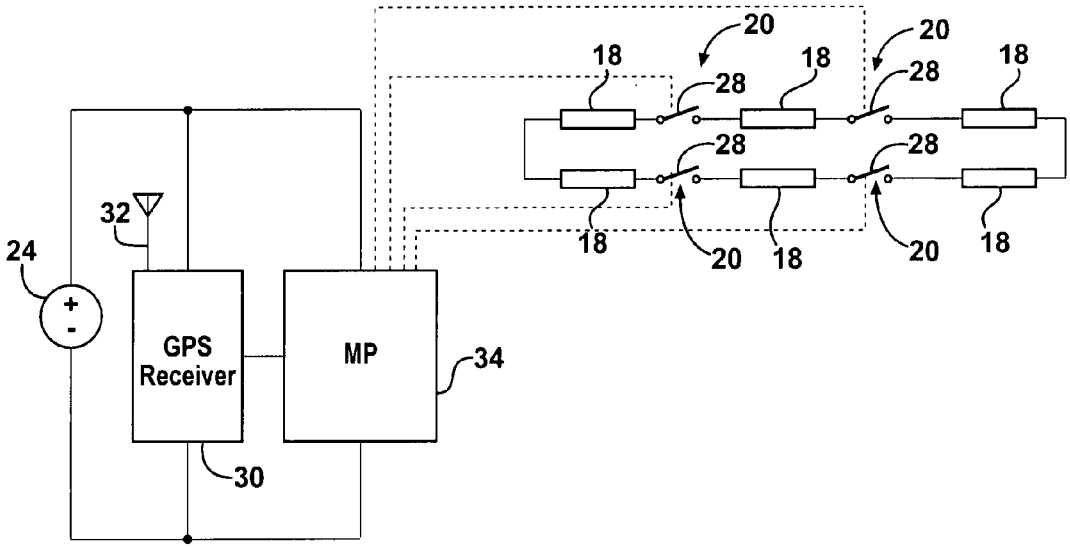
FIG. 6 is a schematic diagram of a circuit showing mechanical switches implemented as the linking switches.

In a second configuration, as shown in FIG. 6, each linking switch 20 is implemented as a mechanical switch 28. For instance, the linking switch may be a MEMS switch. Other suitable devices for implementing the mechanical switch 28 are known to those skilled in the art. In both the first and second configurations, it is preferred that each linking switch 20 is disposed on the nonconductive pane and generally in-line and co-planar with the parasitic elements 18. However, the linking switches 20 may alternatively be disposed away from the parasitic elements 18, such as on a printed circuit board or other such device.

Figure 7:
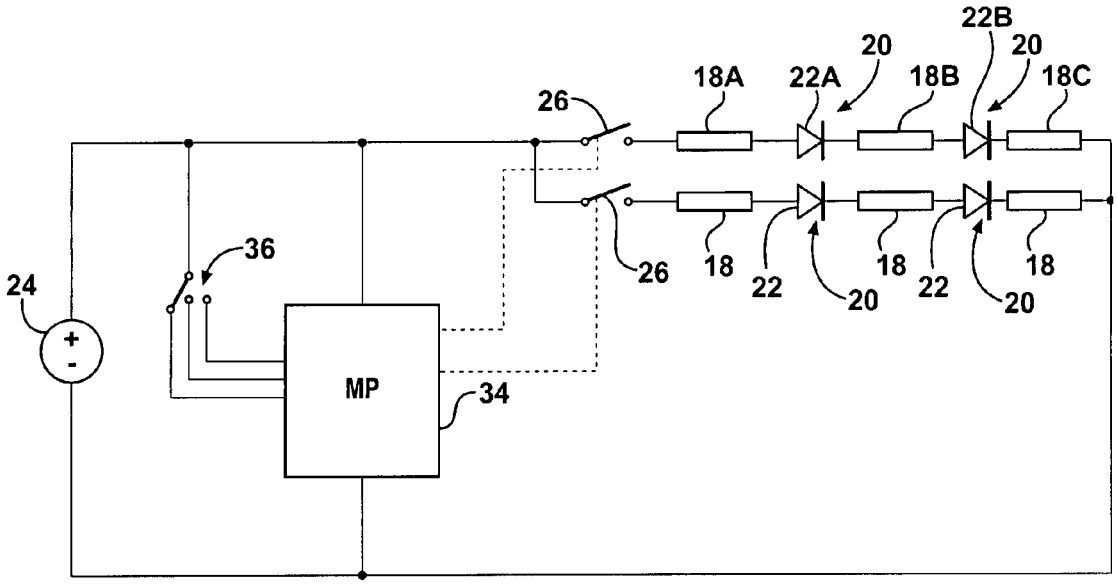
FIG. 7 is a schematic diagram of a circuit showing the linking switches activated manually via a selector switch.

The linking of the parasitic elements 18 via the linking switches 20 may be accomplished either manually or automatically. In an automatic arrangement, a global positioning system (GPS) receiver 30, as shown in FIGS. 6 and 7, is utilized to determine the geographic location of the antenna system 10. The GPS receiver 30 includes a GPS antenna 32 for receiving signals from GPS satellites in orbit around the Earth. The GPS receiver 30 calculates the geographic location based on the relative delay between the signals, as is well known to those skilled in the art.

In the automatic arrangement, the antenna system 10 connects or disconnects the various parasitic elements 18 from one another based on the geographic location provided by the GPS receiver 30. Preferably, the antenna system 10 includes a microprocessor 34 in communication with the GPS receiver 30 for receiving the geographic location. The microprocessor 34 then utilizes this information to connect or disconnect the various parasitic elements 18 from one another, thus changing the radiation pattern of the antenna system 10. Said another way, the microprocessor 34 activates and deactivates the linking switches 20. Specifically, in the first configuration, the microprocessor 34 controls the activation switches 26 to connect or disconnect the voltage source 24. Thus, the diodes 22 of the first configuration are activated or deactivated.

As the antenna system 10 moves, such as when the vehicle moves, the GPS receiver 30 updates the geographic location accordingly and relays this updated information to the microprocessor 34. The microprocessor 34 then may activate or deactivate the linking switches 20 appropriately based on geographic location without intervention by a user.

Figure 8:
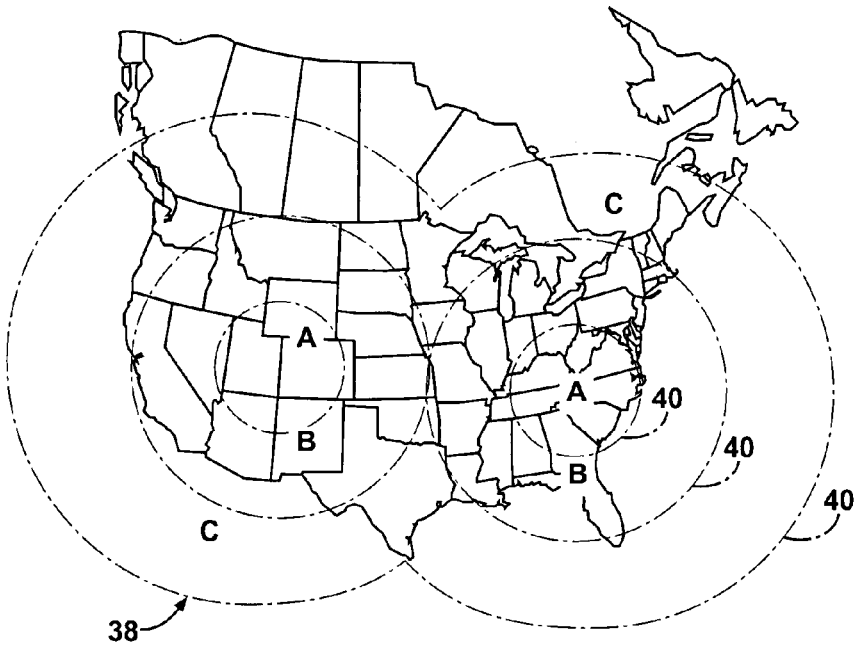
FIG. 8 is a graphic showing a map with regions corresponding to selections available on the selector switch.

In a manual arrangement, as shown in FIG. 7, the antenna system 10 includes a selector switch 36 which is adjustable by a user. The user preferably adjusts the selector switch 36 based on the geographic location of the antenna system 10. To this end, and in one possible implementation, the selector switch 36 is labeled "A", "B", and "C" (not shown). The user references a map 38, as shown in FIG. 8, representing coverage of the satellites, e.g., Sirius or XM satellites. The map 38 shows delineated regions 40 also labeled "A", "B", and "C". The user simply identifies their current geographic location and adjusts the selector switch 36 accordingly. The selector switch 36 is in communication with the linking switches 20 to activate the linking switches 20 accordingly. In the illustrated embodiment, as shown in FIG. 7, the microprocessor 34 provides communication between the selector switch 34 and the activation switches 26. The map 38 may be printed on a cover (not shown) of the antenna system 10 near the selector switch 36, on instructions accompanying the vehicle, or other locations as is easily identifiable by those skilled in the art.

Other techniques for manually determining the geographic location of the antenna system 10, other than the map 38, are appreciated by those skilled in the art. For instance, the user may refer to a list or database of geographically dependent information, such as states, telephone area codes, postal ZIP codes, etc., which correlate to one of the regions 40 and/or selector switch 36 settings. Of course, the manual arrangement of the present invention is not limited to a selector switch 36 with only three selections (e.g., "A", "B", and "C"). The selector switch 36 may have a setting for each different radiation pattern 11 that is available by the antenna system 10.

Those skilled in the art realize that other devices or techniques may be used, other than the microprocessor 34, for receiving the location of the antenna system 10 (from either the GPS receiver 30 or the selector switch 36) and controlling the linking switches 20. For instance, an application specific integrated circuit (ASIC) could be utilized. Furthermore, the computing and storage provided by the microprocessor 34 may be integrated into other systems of the accompanying vehicle or receiver. Lastly, in the manual arrangement, the microprocessor 34 may be omitted completely and implemented using basic circuit design techniques.

The manual arrangement, which doesn't require the GPS receiver 30 or the microprocessor 34, provides an extremely low-cost implementation of the antenna system 10. This low-cost implementation is advantageous to vehicle manufacturers and OEMs who are under relentless pressure to cut vehicle costs while still providing technological improvements.

However, even implementing the automatic arrangement of the antenna system 10 provides significant cost savings over prior art antenna systems, which typically require multiple radiating elements. Furthermore, utilizing the single conductive patch 14 provides minimal obstruction of the window and thus does not significant reduce the view of the driver of the vehicle.

Nevertheless, an antenna system (not shown) may be formed by arranging several radiating elements 12 of the described invention together. For instance, several conductive patches 14 may be located at several locations of the window and/or the vehicle. The conductive patch 14 providing the best overall signal is then connected to the receiver via a control switch (not shown). Alternatively, the best overall signal from the combination of the several radiating elements 12 can be connected to the receiver via a combining circuit (not shown) as is well known to those skilled in the art.

As stated above, the subject invention includes a method of steering the radiation pattern 11. Although the method is described above in relationship to the antenna system 10, for convenience purposes, the steps of the methods are reiterated hereafter.

The method preferably utilizes the antenna system 10 which includes the radiating element 12 and the plurality of parasitic elements 18. The parasitic elements 18 are disposed in proximity of the radiating element 12 such that the parasitic elements 18 affect the geometry of the radiation pattern 11. The method includes the step of exciting the radiation pattern 11 with the radiation element 12. Of course, the excitation of the radiation pattern may be accomplished merely by electrically connecting the receiver to the radiating element 12.

The method also includes the step of electrically connecting at least two of the parasitic elements 18 together with the linking switch 20 based on the geographic location to steer the radiation pattern 11.

In the first configuration, the linking switch 20 is further defined as the diode 22. Accordingly, in the first configuration, the step of electrically connecting at least two of the parasitic elements 18 together is further defined as electrically connecting the voltage source 24 across at least two of the parasitic elements 18 such that current may flow through the linking switch 20 and between the parasitic elements 18 to steer the radiation pattern 11.

In the automatic arrangement, the method may include the step of determining the geographic location based on GPS satellite signals. The step of electrically connecting at least two of the parasitic elements 18 is performed automatically based on the geographic location.

In the manual arrangement, the method may include the step of determining the geographic location based on referencing a map 38 delineated into regions 40. The method may also include the step of determining the geographic location by referencing a list or database of geographically dividable information to obtain the region 40. Furthermore, the step of electrically connecting at least two of the parasitic elements 18 is performed manually by a user.

The present invention has been described herein in an illustrative manner, and it is to be understood that the terminology which has been used is intended to be in the nature of words of description rather than of limitation.

Obviously, many modifications and variations of the invention are possible in light of the above teachings. The invention may be practiced otherwise than as specifically described within the scope of the appended claims. In addition, the reference numerals in the claims are merely for convenience and are not to be read in any way as limiting.

What is claimed is:

1. An antenna system (10) exhibiting a radiation pattern (11) at a desired operating frequency that is steerable, said antenna system (10) comprising:

a radiating element (12) for exciting the radiation pattern (11);

a plurality of parasitic elements (18) disposed a distance from said radiating element (12) which is between 0.01 and 0.1 wavelengths of the desired operating frequency of said antenna system (10) such that said parasitic elements (18) affect a geometry of the radiation pattern (11); and at least one linking switch (20) electrically connected to at least two of said parasitic elements (18) and activatable to electrically connect said at least two parasitic elements (18) together for steering the radiation pattern (11).

2. An antenna system (10) as set forth in claim 1 wherein said at least one linking switch (20) is further defined as a plurality of linking switches (20) with each linking switch (20) electrically connected to two of said parasitic elements (18) and activatable to electrically connect said two parasitic elements (18) together for steering the radiation pattern (11).

3. An antenna system (10) as set forth in claim 1 wherein said linking switch (20) is further defined as a diode (22).

4. An antenna system (10) as set forth in claim 3 wherein said plurality of parasitic elements (18) is further defined as a first parasitic element (18A) and a second parasitic element (18B) and wherein an anode of said diode (22) is electrically connected to said first parasitic element (18A) and a cathode of said diode (22) is electrically connected to said second parasitic element (18B).

5. An antenna system (10) as set forth in claim 4 further comprising a voltage source (24) having a voltage sufficient to allow current flow through said diode (22) and an activation switch (26) electrically connected between said voltage source (24) and said first parasitic element (18A) for selectively connecting said voltage source (24) to said first parasitic element (18A).

6. An antenna system (10) as set forth in claim 1 wherein said linking switch (20) is further defined as a microelectromechanical systems (MEMS) switch (28).

7. An antenna system (10) as set forth in claim 1 wherein said radiating element (12) is further defined as a conductive patch (14).

8. An antenna system (10) as set forth in claim 7 wherein said conductive patch (14) is disposed on a nonconductive pane (16) formed of transparent material.

9. An antenna system (10) as set forth in claim 7 wherein said conductive patch (14) defines a generally rectangular shape having four sides.

10. An antenna system (10) as set forth in claim 9 wherein said plurality of parasitic elements (18) is arranged as four lines of parasitic elements (18) wherein each of said lines of parasitic elements (18) is disposed adjacent to one of said sides of said conductive patch (14).

11. An antenna system (10) as set forth in claim 10 wherein each of said lines of parasitic elements (18) is disposed generally parallel to one of said sides of said conductive patch (14).

12. An antenna system (10) as set forth in claim 7 wherein said plurality of parasitic elements (18) are arranged as at least one line of parasitic elements (18) disposed adjacent said conductive patch (14).

13. An antenna system (10) as set forth in claim 1 wherein said at least one linking switch (20) is manually operable by a user.

14. An antenna system (10) as set forth in claim 1 wherein said at least one linking switch (20) is automatically operable based on a geographic position of said antenna system (10).

15. An antenna system (10) as set forth in claim 14 further comprising a global positioning system (GPS) receiver (30) in communication with said linking switches (20) for determining the geographic location.

16. An antenna system (10) as set forth in claim 15 further comprising a microprocessor (34) in communication with said GPS receiver (30) and said linking switches (20) for activating said linking switches (20) based on the geographic location received from said GPS receiver (30).

17. An antenna system (10) exhibits a radiation pattern (11) that is steerable based on geographic location, said antenna system (10) comprising:

a conductive patch (14) for exciting the radiation pattern (11);

a first parasitic element (18A) and a second parasitic element (18B) disposed adjacent to said conductive patch (14) such that said parasitic elements (18A, 18B) affect a geometry of the radiation pattern (11); and a first diode (22A) having an anode electrically connected to said first parasitic element (18A) and a cathode electrically connected to said second parasitic element (18B);

a voltage source (24) having a voltage sufficient to allow current to flow through said first diode (22A) and between said first parasitic element (18A) and said second parasitic element (18B); and an activation switch (26) electrically connected between said voltage source (24) and said first parasitic element (18A) for selectively connecting said voltage source (24) to said first parasitic element (18A) such that current may flow between said first and second parasitic elements (18A, 18B) to steer the radiation pattern (11).

18. An antenna system (10) as set forth in claim 17 further comprising a third parasitic element (18C) disposed adjacent to said conductive patch (14) such that said third parasitic element (18C) also affects the geometry of the radiation pattern (11).

19. An antenna system (10) as set forth in claim 18 further comprising a second diode (22B) having an anode electrically connected to said second parasitic element (18B) and a cathode electrically connected to said third parasitic element (18C) such that said second and third parasitic elements (18B, 18C) are electrically connectable together to further steer the radiation pattern (11).

20. A method of steering a radiation pattern of an antenna system (10) based upon geographic location of the antenna system (10), the antenna system (10) including a radiating element (12) and a plurality of parasitic elements (18) disposed in proximity of the radiating element (12) such that the parasitic elements (18) affect a geometry of the radiation pattern (11), said method comprising the steps of:

determining the geographic location of the antenna system (10);

exciting the radiation pattern (11) with the radiation element (12);

electrically connecting at least two of the parasitic elements (18) together with a linking switch (20) such that various radiation patterns (11A, 11B, 11C) are presented by the antenna system (10); and selecting the radiation pattern (11) based on the geographic location of the antenna system (10).

21. A method as set forth in claim 20 wherein the linking switch is further defined as a diode (22) and said step of electrically connecting at least two of the parasitic elements (18) together is further defined as electrically connecting a voltage source (24) across at least two of the parasitic elements (18) such that current may flow between the parasitic elements (18) to steer the radiation pattern.

22. A method as set forth in claim 20 further comprising the step of determining the geographic location based on GPS satellite signals and wherein said step of electrically connecting at least two of the parasitic elements (18) is performed automatically based on the geographic location.

23. A method as set forth in claim 20 further comprising the step of determining the geographic location based on referencing a map (38) delineated into regions (40) and wherein said step of electrically connecting at least two of the parasitic elements (18) is performed manually by a user.

24. A method as set forth in claim 20 further comprising the step of determining the geographic location by referencing a list or database of geographically dividable information to obtain the region (40) and wherein said step of electrically connecting at least two of the parasitic elements (18) is performed manually by a user.

25. An antenna system (10) as set forth in claim 9 wherein said parasitic elements (18) are disposed in a line adjacent one of said sides of said conductive patch (14).

26. An antenna system (10) as set forth in claim 9 wherein a length of each parasitic element (18) is less than a length of any side of said conductive patch (14).

27. An antenna system (10) exhibiting a radiation pattern (11) that is steerable, said antenna system (10) comprising:

a conductive patch (14) for exciting the radiation pattern (11), said conductive patch (14) having a plurality of sides;

a plurality of parasitic elements (18) arranged as at least one pair of lines of parasitic elements (18) disposed adjacent one of said sides of said conductive patch (14) such that said parasitic elements (18) affect a geometry of the radiation pattern (11); and at least one linking switch (20) electrically connected to at least two of said parasitic elements (18) and for electrically connecting said at least two parasitic elements (18) together to steer the radiation pattern (11).

28. An antenna system (10) as set forth in claim 27 wherein said conductive patch (14) defines a generally square shape having four sides and wherein said plurality of parasitic elements (18) is arranged as four lines of parasitic elements (18), wherein each of said lines of parasitic elements (18) is disposed adjacent to one of said sides of said conductive patch (14).

* * * * *